US010339889B2

(12) United States Patent
Shibuya et al.

(10) Patent No.: US 10,339,889 B2
(45) Date of Patent: Jul. 2, 2019

(54) LIQUID CRYSTAL DRIVE DEVICE AND LIQUID CRYSTAL DRIVE METHOD

(71) Applicant: KABUSHIKI KAISHA TOSHIBA, Tokyo (JP)

(72) Inventors: Tomohiro Shibuya, Kanagawa (JP); Takeshi Suyama, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 138 days.

(21) Appl. No.: 15/438,478

(22) Filed: Feb. 21, 2017

(65) Prior Publication Data

US 2018/0082655 A1 Mar. 22, 2018

(30) Foreign Application Priority Data

Sep. 21, 2016 (JP) ..... 2016-184340

(51) Int. Cl.
*G09G 3/36* (2006.01)

(52) U.S. Cl.
CPC ..... *G09G 3/3696* (2013.01); *G09G 3/3614* (2013.01); *G09G 3/3622* (2013.01); *G09G 3/3648* (2013.01); *G09G 2310/0289* (2013.01); *G09G 2310/065* (2013.01); *G09G 2310/08* (2013.01); *G09G 2320/066* (2013.01)

(58) Field of Classification Search
CPC ..... G09G 3/3696; G09G 3/3648; G09G 2310/0289; G09G 2320/066; G09G 2310/08; G09G 2300/0861; G09G 2310/0213; G09G 2310/06;
(Continued)

(56) References Cited

U.S. PATENT DOCUMENTS 4,604,617 A 8/1986 Morozumi
6,204,831 B1 3/2001 Nishioka et al.
(Continued)

FOREIGN PATENT DOCUMENTS

JP S55163589 A 12/1980
JP S5978394 A 5/1984
(Continued)

OTHER PUBLICATIONS

Japanese Office Action dated Apr. 16, 2019, mailed in counterpart Japanese Application No. 2016-184340, 6 pages (with translation).

*Primary Examiner* — Jennifer T Nguyen
(74) *Attorney, Agent, or Firm* — Kim & Stewart LLP

(57) ABSTRACT

A liquid crystal drive device includes a common driver configured to sequentially output a scanning signal having a plurality of voltage levels to a plurality of common wirings in a time division manner, a segment driver configured to output a display signal having a plurality of voltage levels to a plurality of segment wirings, and a contrast adjustment unit configured to generate contrast adjustment periods that are inserted into all duty periods, and output, to the common driver and the segment driver, a contrast control signal to control the timing of when the contrast adjustment periods are inserted into the duty periods in synchronization with the timing of the scanning signal and the display signal. The scanning signal and the display signal are output at an identical potential when a contrast adjustment period is indicated by the output of the contrast control signal.

20 Claims, 6 Drawing Sheets

(58) Field of Classification Search
CPC ..... G09G 2310/067; G09G 2310/02; G09G 2310/0202
USPC ..... 345/87, 89, 94, 204
See application file for complete search history.

(56) References Cited

U.S. PATENT DOCUMENTS

| | | | | |
|---|---|---|---|---|
| 2006/0262071 | A1* | 11/2006 | Shieh | G09G 3/3677 345/100 |
| 2007/0229432 | A1* | 10/2007 | Kimura | G09G 3/3614 345/96 |
| 2008/0238897 | A1* | 10/2008 | Kimura | G09G 3/3614 345/204 |
| 2009/0167660 | A1* | 7/2009 | Wang | G09G 3/3637 345/89 |
| 2009/0167739 | A1* | 7/2009 | Tsubata | G09G 3/3659 345/208 |

FOREIGN PATENT DOCUMENTS

| | | | |
|---|---|---|---|
| JP | S5936486 | A | 12/1984 |
| JP | S60220314 | A | 11/1985 |
| JP | H026921 | A | 1/1990 |
| JP | H0588647 | A | 4/1993 |
| JP | H06208344 | A | 7/1994 |
| JP | H0854600 | A | 2/1996 |
| JP | H09311313 | A | 12/1997 |
| JP | H1152332 | A | 2/1999 |
| JP | 2000194307 | A | 7/2000 |
| JP | 2000310762 | A | 11/2000 |
| JP | 2012053117 | A | 3/2012 |

* cited by examiner

FIG. 4

| INPUT | | | OUTPUT | |
|---|---|---|---|---|
| FR | DATA | CC | SEG | COM |
| 0 | 0 | 0 | V2 | V1 |
| 0 | 1 | 0 | V0 | V3 |
| 1 | 0 | 0 | V1 | V2 |
| 1 | 1 | 0 | V3 | V0 |
| any | any | 1 | V0 | V0 |

LIQUID CRYSTAL DRIVE DEVICE AND LIQUID CRYSTAL DRIVE METHOD

CROSS-REFERENCE TO RELATED APPLICATION

This application is based upon and claims the benefit of priority from Japanese Patent Application No. 2016-184340, filed Sep. 21, 2016, the entire contents of which are incorporated herein by reference.

FIELD

Embodiments described herein relate generally to a liquid crystal drive device and a liquid crystal drive method.

BACKGROUND

A liquid crystal display apparatus is a display that is driven at a low voltage and consumes low electric power and is widely used in a display unit of a clock, an electronic desk calculator, an electronic game, a remote controller, a price tag, and the like.

In the related art, this type of liquid crystal display apparatus is provided with a plurality of scanning electrodes (common wirings) extending in a row direction and a plurality of signal electrodes (segment wirings) extending in a column direction so as to intersect the common wirings. Pixels are formed so as to correspond to intersecting positions between the common wirings and the segment wirings. As a method of driving the liquid crystal display apparatus, a multiplexing drive method is mainly used. In the multiplexing drive method, the common wirings are sequentially selected and driven, and a drive voltage corresponding to a display image is applied to the segment wirings in synchronization with a selection period of the common wirings.

As a method of adjusting contrast in the display image, a method of controlling the drive voltage is typically used. As a higher drive voltage is applied, the contrast in the image increases. In contrast, as a lower drive voltage is applied, the contrast in the image decreases. In order to adjust the contrast in the image by making the drive voltage variable, it is necessary to add a voltage boosting circuit (power source circuit) provided with a voltage adjusting circuit to the liquid crystal drive device or to adjust the voltage applied from the outside to the liquid crystal drive device. Therefore, the size of the circuit will increase.

However, a power source voltage provided to the liquid crystal drive device, which is mounted on a device using this type of liquid crystal display apparatus, is typically low, such as about 1.5 to 5 V in order to meet low power consumption requirements. Therefore, there is a problem in which the addition of the voltage boosting circuit to the inside of the apparatus and the adjustment of the voltage applied from the outside leads to an increase in the size of the circuit, an increase in cost and an increase in the size of the chip.

In this regard, a liquid crystal drive device has been proposed which was capable of adjusting shading of an image by providing a contrast adjustment period for setting the same potential for the common wirings and the segment wirings after applying the drive voltage corresponding to a desired display image to the segment wirings for a predetermined period. That is, as a shorter contrast adjustment period is set, the contrast in the image increases. In contrast, as a longer contrast adjustment period is set, the contrast in the image decreases.

However, if the contrast is adjusted by adding the contrast adjustment period, a frame period, which includes a period in which the drive voltage is applied, and the contrast adjustment period will vary in accordance with a degree of the shading. Therefore, to resolve this problem it is necessary to add an adjustment circuit so that the frame period is held constant. However, due to the addition of the adjustment circuit, the size of the circuit will need to increase.

DESCRIPTION OF THE DRAWINGS

FIG. 4 is a diagram illustrating a correspondence of input and output values of a common driver and a segment driver.

DETAILED DESCRIPTION

Embodiments provide a liquid crystal drive device and a liquid crystal drive method capable of adjusting contrast of a displayed image without increasing the size of a circuit used to generate the image.

In general, according to one embodiment, a liquid crystal drive device drives a liquid crystal display apparatus, which includes a plurality of common wirings, a plurality of segment wirings, a common driver configured to sequentially output a scanning signal having a plurality of voltage levels to the plurality of common wirings in a time division manner, and a segment driver configured to output a display signal having a plurality of voltage levels to the plurality of segment wirings. The liquid crystal drive device also includes a contrast adjustment unit configured to generate contrast adjustment periods that are inserted into all duty periods, and output, to the common driver and the segment driver, a contrast control signal to control the timing of when the contrast adjustment periods are inserted into the duty periods in synchronization with the timing of the scanning signal and the display signal. The scanning signal and the display signal are output at an identical potential when a contrast adjustment period is indicated by the output of the contrast control signal.

Hereinafter, description will be given of embodiments with reference to drawings.

(First Embodiment)

Figure 1:
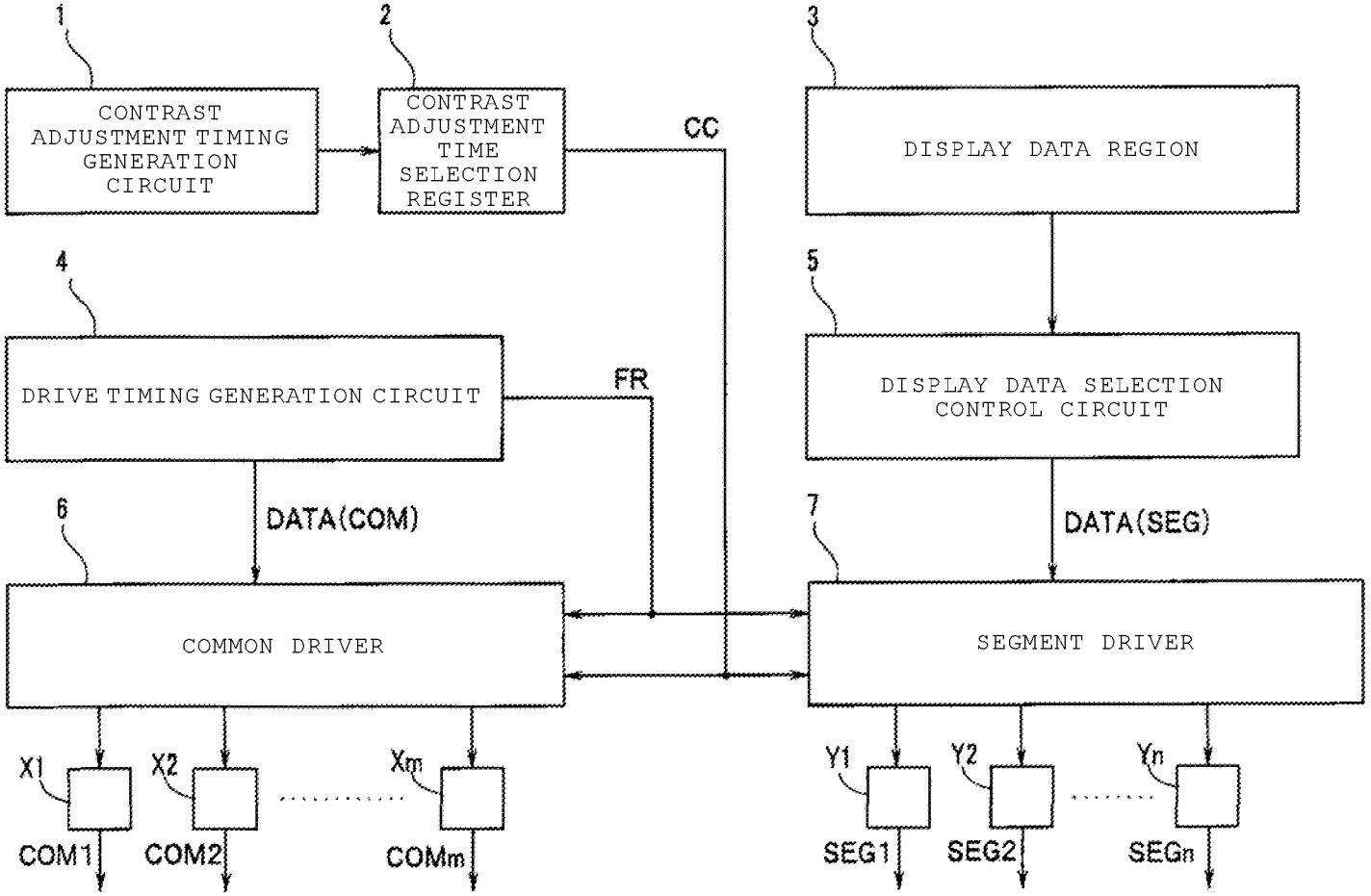
FIG. 1 is a block diagram of a configuration of a liquid crystal drive device according to a first embodiment.

FIG. 1 is a block diagram of a configuration of a liquid crystal drive device according to a first embodiment. The liquid crystal drive device illustrated in FIG. 1 includes a contrast adjustment timing generation circuit 1, a contrast adjustment time selection register 2, a drive timing generation circuit 4, a display data region 3, and a display data selection control circuit 5. The liquid crystal drive device also includes a plurality of common electrodes X1, X2, . . . Xm, a plurality of segment electrodes Y1, Y2, . . . Yn, a common driver 6, and a segment driver 7.

The drive timing generation circuit 4 generates a clock signal (not illustrated) for synchronization of the timing operations in the entire liquid crystal drive circuit and outputs the clock signal to the common driver 6, the segment driver 7, and the contrast adjustment timing generation circuit 1. The drive timing generation circuit 4 outputs a data signal DATA(COM) to the common driver 6. The data signal DATA(COM) is a drive signal for supplying a prescribed selection voltage to the common electrodes X1, X2, . . . Xm and scanning the respective common wirings in a liquid crystal display unit (not illustrated) connected to the respective common electrodes at a predetermined time. Furthermore, the drive timing generation circuit 4 outputs a frame inversion signal FR to the common driver 6 and the segment driver 7 and inverts signals to be applied to the common electrodes and the segment electrodes every frame.

The display data region 3 temporarily stores input image data to be displayed by a liquid crystal display apparatus (not illustrated) . The display data selection control circuit 5 reads image data DATA(SEG) for a predetermined line to be output next from the display data region 3, and outputs the image data DATA(SEG) to the segment driver 7.

The contrast adjustment timing generation circuit (contrast adjustment unit) 1 generates a timing (the length of contrast adjustment periods and arrangement of the contrast adjustment periods in the respective duty periods) at which a voltage to be applied to the common electrodes and a voltage to be applied to the segment electrodes are set to the same value in the duty periods of the respective frames. The contrast adjustment time selection register 2 selects an appropriate timing according to desired contrast, and outputs the timing as a contrast control signal CC to the common driver 6 and the segment driver 7 if the contrast adjustment timing generation circuit 1 generates a plurality of timings.

The common driver 6 outputs scanning signals COM1, COM2, . . . COMm to the respective common wirings of the liquid crystal display apparatus based on the data signal DATA(COM), the frame inversion signal FR, and the contrast control signal CC. The common driver 6 appropriately outputs the scanning signals COM1, COM2, . . . COMm, thereby driving the respective corresponding common wirings while setting common wirings in a scanning state.

The segment driver 7 outputs display signals SEG1, SEG2, . . . SEGn to the respective segments of the liquid crystal display apparatus connected to the electrodes Y1, Y2, . . . Yn based on the image data DATA(SEG) input from the display data selection control circuit 5, the frame inversion signal FR, and the contrast control signal CC. The segment driver 7 appropriately outputs the display signals SEG1, SEG2, . . . SEGn, thereby applying a predetermined voltage to the respective corresponding segments.

Figure 2:
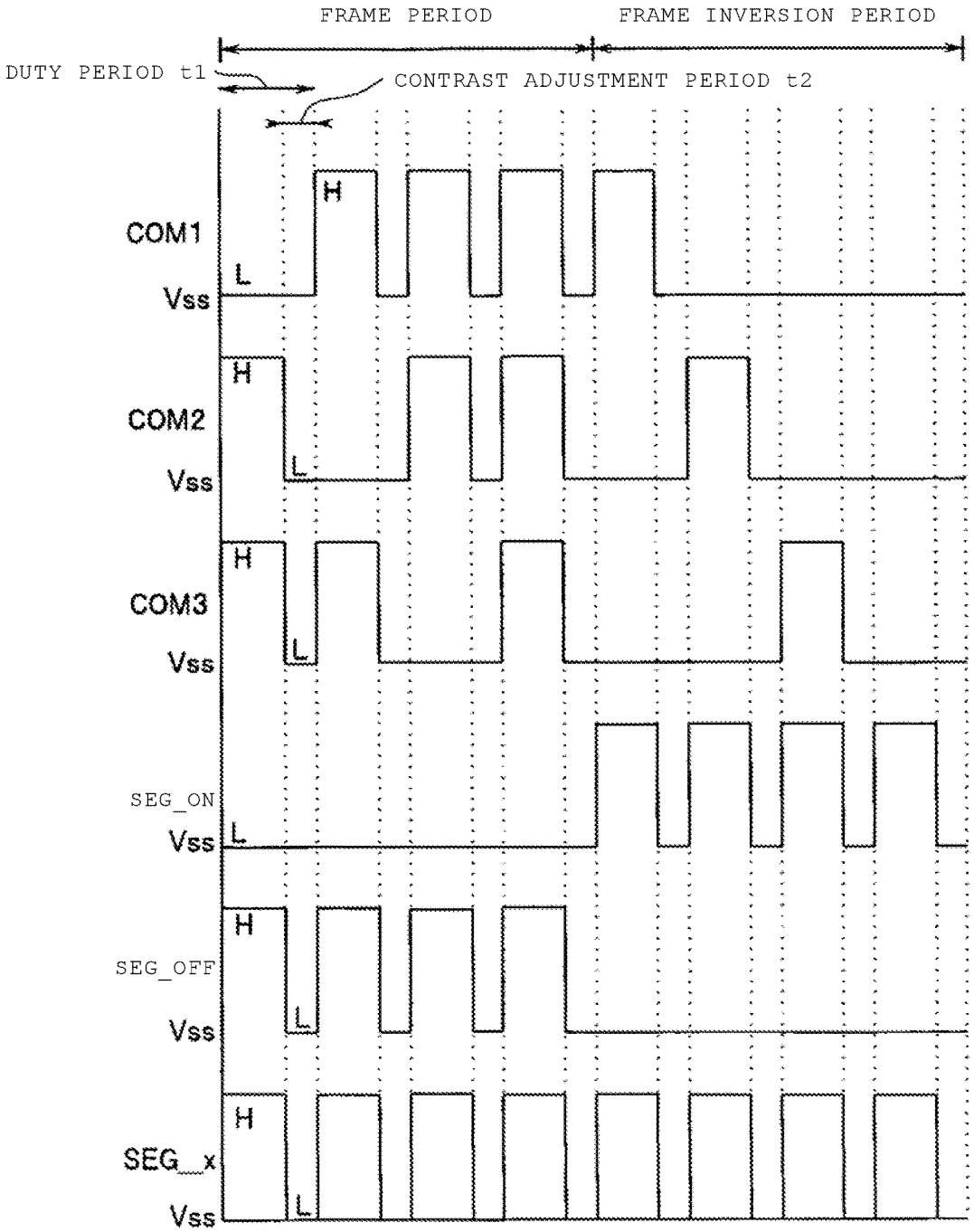
FIG. 2 is a waveform diagram illustrating an example of operations of the liquid crystal drive device according to the first embodiment.

Next, description will be given of operations of the liquid crystal drive device according to the embodiment. FIG. 2 is a waveform diagram illustrating an example of operations of the liquid crystal drive device according to the first embodiment. FIG. 2 illustrates an example of drive waveforms of three scanning signals COM1, COM2, and COM3 in a one-quarter duty driven liquid crystal drive device. FIG. 2 also illustrates a waveform representing when all the display signals SEGn are turned ON (represented as SEG_ON in FIG. 2), a waveform representing when the display signals SEGn are turned OFF (represented as SEG_OFF in FIG. 2), and a waveform of comprehensive display signals SEGn in a combination of ON and OFF states (represented as SEG_x in FIG. 2).

The liquid crystal drive device according to the first embodiment uses only two values, namely a high-potential ("H") drive waveform and a low-potential ("L") drive waveform for both the scanning signals COM1, COM2, . . . COMm and the display signals SEG1, SEG2, . . . SEGn. In the driving method, a selection signal is turned to "L" in an ON period t1, during which image data for one line is displayed, and is sequentially shifted from the scanning signals COM1 towards COMm in a frame period.

In contrast, the segment driver 7 generates drive waveforms of the display signals SEG1, SEG2, . . . SEGn by an operation from a display pattern of the image data DATA (SEG). In the frame period, the display signals SEG1, SEG2, . . . SEGn output "L" if all the display signals SEG1, SEG2, . . . SEGn are turned ON and output "H" if any of the display signals SEG1, SEG2, . . . SEGn are turned OFF.

In a frame inversion period, a selection signal that is turned to "H" in an ON period (duty period t1), during which image data for one line is displayed, is output while being sequentially shifted from the scanning signal COM1 towards COMm. The display signals SEG1, SEG2, . . . SEGn output "H" if all the display signals SEG1, SEG2, . . . SEGn are turned ON and output "L" if the display signals SEG1, SEG2, . . . SEGn are turned OFF.

Here, all the scanning signals COMm and all the display signals SEGn output "L" only for a contrast adjustment period t2 designated by the contrast control signal CC in all the duty periods t1 in the frame period and the frame inversion period. For example, the scanning signal COM2 outputs "H" in the first duty period in the frame period since this period is an OFF period while outputting "L" in the final contrast adjustment period t2 in the duty period t1. Similarly, the other scanning signals COM1, COM2, . . . COMm and the display signals SEG1, SEG2, . . . SEGn output "H" in the duty period corresponding to the OFF period while outputting "L" in the final contrast adjustment period t2 in the duty period t1.

Pixels arranged in the liquid crystal display apparatus changes contrast in accordance with the length of time during which there is a difference between a potential applied to the common wirings COMm and a potential applied to the segment wirings SEGn connected thereto. That is, as the time during which there is a difference in the potentials becomes longer, the contrast increases. As the time during which there is a difference in the potentials becomes shorter, the contrast decreases. Therefore, it is possible to obtain desired contrast by changing the length of the contrast adjustment period t2 during which both the potential applied to the common wirings COMm and the potential applied to the segment wirings SEGn are "L", and thus no difference exists between the potentials.

According to the embodiment, during the contrast adjustment period t2 the potential applied to all the common wirings COMm and the potential applied to all the segment wirings SEGn are at the same potential, and an output potential is provided during all the duty periods t1 as described above. It is possible to adjust the contrast in the image to be output to desired shading by changing the length of the contrast adjustment period t2. Therefore, since there is no need to boost the potentials that are applied to the common wirings COMm and the segment wirings SEGn to a higher potential, it is possible to suppress an increase in the size of the formed circuit.

Since the contrast adjustment period t2 is provided in all the duty periods, the length of the frame period is not changed even if the contrast is changed. Therefore, since there is no need to provide a circuit for adjusting the time to output an image, for example, it is possible to suppress an increase in the size of the circuit.

In the waveform illustrated in FIG. 2, "L" is output to all the common wirings COMm and the segment wirings SEGn in the contrast adjustment period t2. However, another potential such as "H' maybe output as long as the same potential is output between the common wirings COMm and the segment wirings SEGn. In FIG. 2, the potential "L" is a ground potential (VSS, 0 V). However, another potential may also be used.

(Second Embodiment)

The liquid crystal drive device according to the first embodiment uses only two values, namely a high-potential ("H") drive waveform and a low-potential ("L") drive waveform for both the scanning signals COM1, COM2, . . . COMm and the display signals SEG1, SEG2, . . . SEGn. In contrast, a liquid crystal drive device according to a second embodiment is different in that four values V0, V1, V2, and V3 are used. Since a configuration of the liquid crystal drive device according to the embodiment is the same as that of the liquid crystal drive device illustrated in FIG. 1, description thereof will be omitted.

Figure 3:
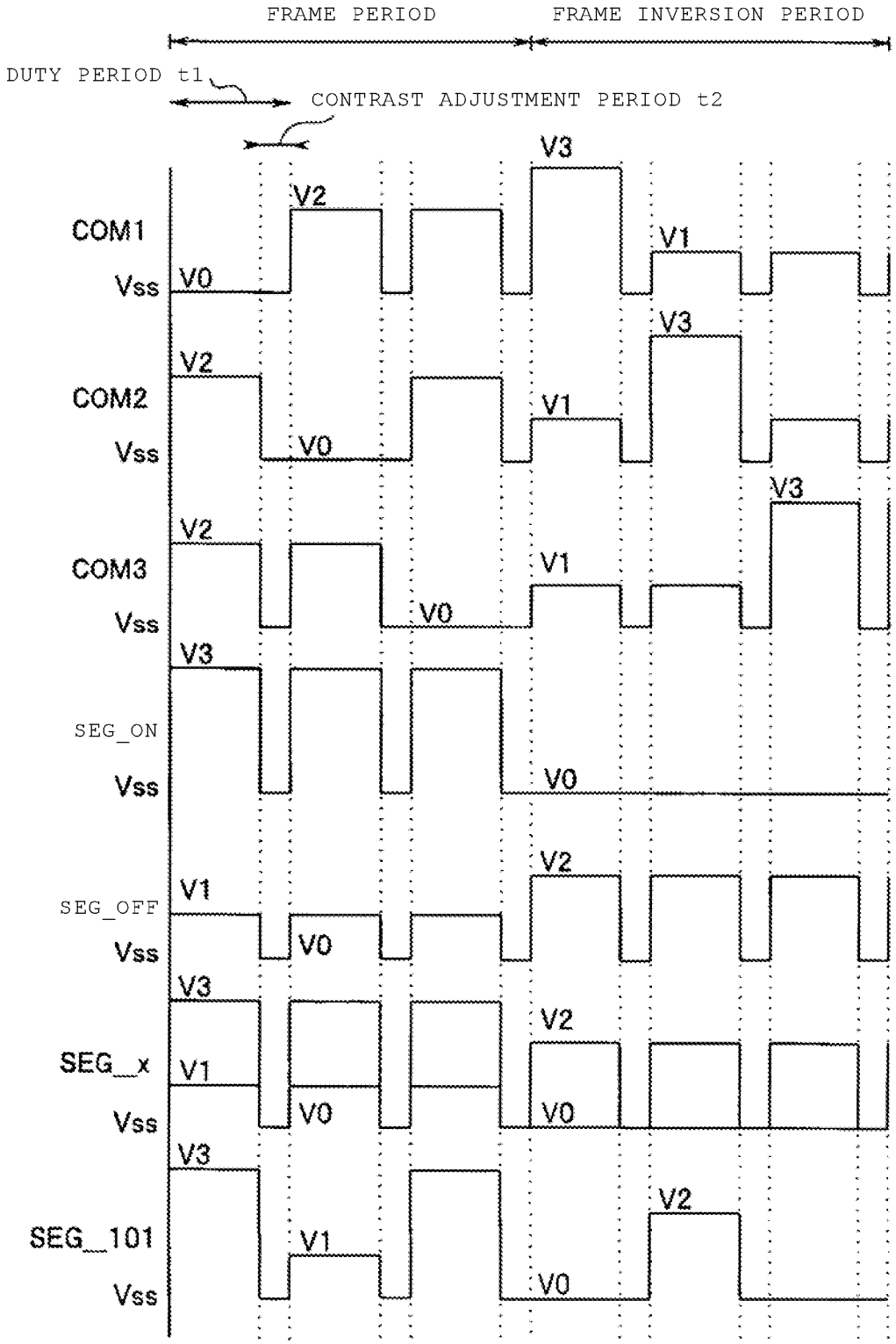
FIG. 3 is a waveform diagram illustrating an example of operations of a liquid crystal drive device according to a second embodiment.

FIG. 3 is a waveform diagram illustrating an example of operations of the liquid crystal drive device according to the second embodiment. FIG. 3 illustrates an example of drive waveforms of three scanning signals COM1, COM2, and COM3 in a one-third duty driven liquid crystal drive device. FIG. 3 illustrates a waveform when all the display signals SEGn are turned on (SEG_ON), a waveform when the display signals SEGn are turned off (SEG_OFF), and a waveform of comprehensive display signals SEGn having a combination of ON and OFF (SEG_x). Furthermore, FIG. 3 also shows a waveform of the display signals SEGn when segment display is "101" (SEG_101).

The scanning signals COM1, COM2, and COM3 output a selection signal that is turned to V0 in the ON period (duty period t1), during which image data for one line is displayed, in the frame period and is sequentially shifted from the scanning signal COM1 toward COMm. In contrast, a selection signal is turned to V3 in the ON period t1, during which image data for one line is displayed, and in the frame inversion period as the selection signal is sequentially shifted from the scanning signal COM1 towards COMm. A non-selection signal of the scanning signals COM1, COM2, and COM3 is V2 in the frame period and is V1 in the frame inversion period.

In contrast, the segment driver 7 generates waveforms for the display signals SEG1, SEG2, . . . SEGn from a display pattern of the image data DATA(SEG). That is, the display signals SEG1, SEG2, . . . SEGn output V3 when all the display signals SEG1, SEG2, . . . SEGn are turned ON and output V1 when the display signals SEG1, SEG2, SEGn are turned OFF in the frame period. The display signals SEG1, SEG2, . . . SEGn output V0 when all the display signals SEG1, SEG2, . . . SEGn are turned ON and output V2 when the display signals SEG1, SEG2, . . . SEGn are turned OFF in the frame inversion period.

For example, when the segment display is "101", V3 is output in the first duty period, V1 is output in the next duty period, and V3 is output in the final duty period in the frame period as represented by the waveform of SEG_101. In the subsequent frame inversion period, V0 is output in the first duty period, V2 is output in the next duty period, and V0 is output in the final duty period.

All the scanning signals COMm and all the display signals SEGn output V0 only in the contrast adjustment period t2 provided by the contrast control signal CC in all the duty periods t1 in the frame period and the frame inversion period. For example, the scanning signal COM2 outputs V2 in the first duty period in the frame period since the duty period is the OFF period while outputting V0 in the final contrast adjustment period t2 in the duty period t1. Similarly, the other scanning signals COM1, COM2, . . . COMm and the display signals SEG1, SEG2, . . . SEGn output V0 in the final contrast adjustment period t2 in all the duty periods t1 regardless of the output potential.

FIG. 4 is a diagram illustrating a correlation of input and output values of the common driver and the segment driver in the liquid crystal drive device according to the second embodiment. Both the scanning signals COM and the display signals SEG output four possible potentials (V0 to V3) while the contrast control signal CC input is "0". However, V0 is output regardless of input values of the frame inversion signal FR and the data signals DATA(COM) and DATA(SEG) while the contrast control signal CC input is "1".

According to the embodiment, during the contrast adjustment period t2 the potential applied to all the common wirings COMm and the potential applied to all the segment wirings SEGn are set to the same potential within each of the duty periods t1 as described above, thereby making it possible to adjust the contrast in the image to be output to a desired shading even when multiple values are used to drive the wirings. Therefore, it is possible to adjust the contrast without changing the potentials applied to the common wirings COMm and the segment wirings SEGn, and thereby suppress the need to increase the size of the circuit.

Since the contrast adjustment period t2 is provided in all of the duty periods t1, the length of the frame length is not changed even if the contrast is changed. Therefore, since there is no need to provide a circuit to adjust the various timing required to output an image, for example, it is possible to suppress the need to increase the size of the circuit.

In FIG. 3, V0 is output to all of the common wirings COMm and the segment wirings SEGn in the contrast adjustment period t2. However, another potential such as V1 may be output as long as the same potential is output to all of the common wirings COMm and the segment wirings SEGn. In FIG. 4, the potential of V0 is a ground potential (VSS, 0 V). However, another potential may also be used.

(Third Embodiment)

As discussed above, the contrast adjustment period t2 is provided at the end of all the duty periods performed on the liquid crystal drive device according to the first embodiment. In contrast, a liquid crystal drive device according to a third embodiment is different in that the arrangement of the contrast adjustment period t2 is different between the even-numbered duty periods and the odd-numbered duty periods. Since a configuration of the liquid crystal drive device according to the embodiment is the same as that of the liquid crystal drive device illustrated in FIG. 1, description thereof will be omitted.

Figure 5:
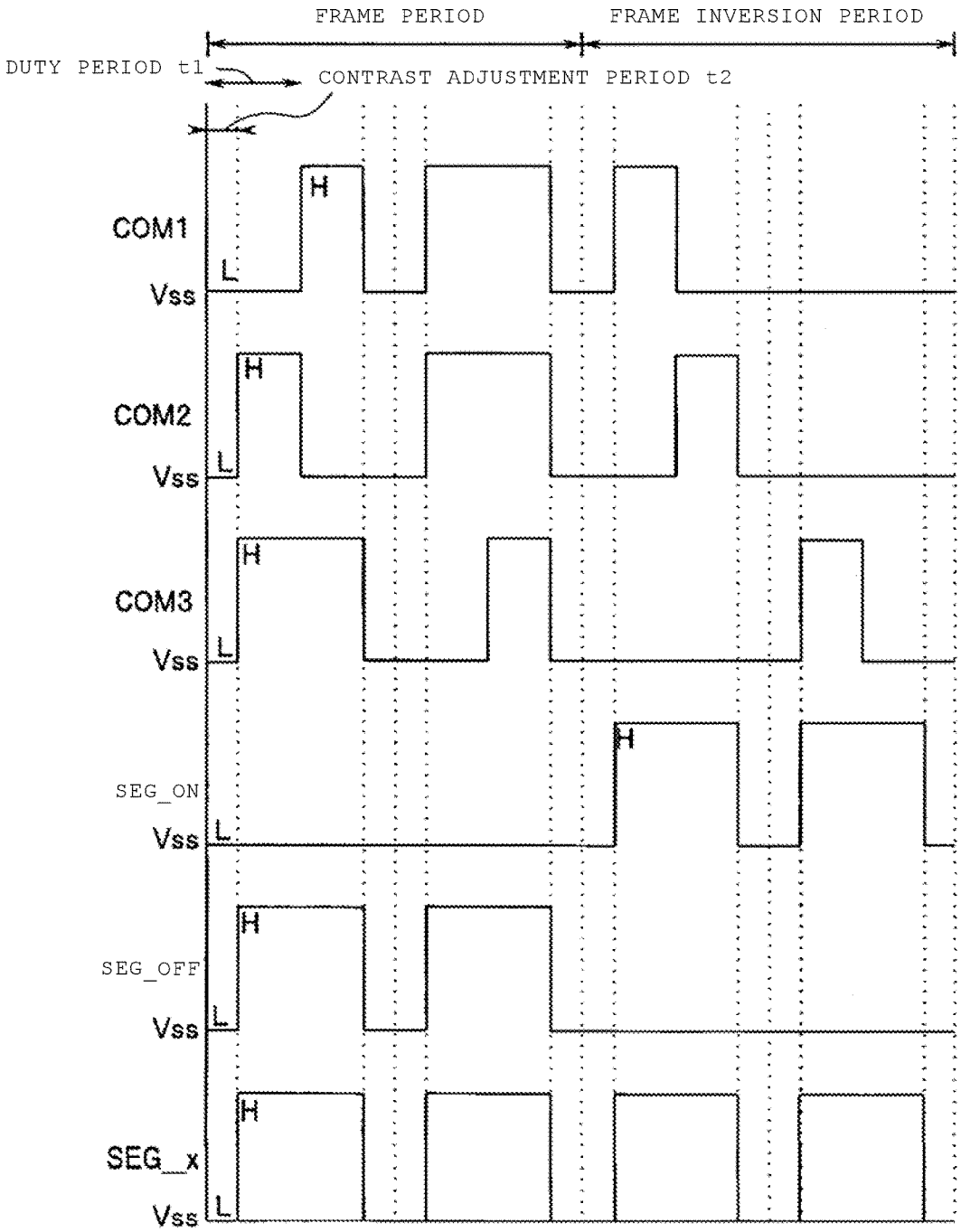
FIG. 5 is a waveform diagram illustrating an example of operations of a liquid crystal drive device according to a third embodiment.

FIG. 5 is a waveform diagram illustrating an example of operations of a liquid crystal drive device according to the third embodiment. FIG. 5 illustrates an example of drive waveforms of three scanning signals COM1, COM2, and COM3 in a one-quarter duty driven liquid crystal drive device. FIG. 5 also illustrates a waveform when all of the display signals SEGn are turned on (SEG_ON), a waveform when the display signals SEGn are turned off (SEG_OFF), and a waveform of comprehensive display signals SEGn in a combination of ON and OFF (SEG_x).

The liquid crystal drive device according to the embodiment uses only two values, namely a high-potential ("H") drive waveform and a low-potential ("L") drive waveform for both the scanning signals COM1, COM2, . . . COMm and the display signals SEG1, SEG2, . . . SEGn. The basic drive waveforms found in the respective duty periods t1 are the same as those of the liquid crystal drive device illustrated in FIG. 2 except for the arrangement of the contrast adjustment periods t2 within the duty periods t1.

In all the duty periods t1, all the scanning signals COMm and all the display signals SEGn output "L" only in the contrast adjustment period t2 as set by the contrast control signal CC. For the even-numbered duty periods, the contrast adjustment period t2 is arranged at the last part of the duty periods t1. For the odd-numbered duty periods, the contrast adjustment period t2 is arranged at the beginning of the duty periods t1.

That is, the contrast adjustment period of the 2i-th duty period and the contrast adjustment period of the 2i+1-st duty period are arranged relative to each other. With such an arrangement, the potential is maintained in "L" until the contrast adjustment period of the 2i+1-st duty period ends from the time at which the potentials of all the scanning signals COMm and all the display signals SEGn are set to "L" at the start of the contrast adjustment period of the 2i-th duty period. Therefore, it is possible to reduce the frequency of switching output values of the scanning signals COMm and the display signals SEGn to a half without changing the length of the contrast adjustment period t2 arranged in each duty period t1.

According to the embodiment, the contrast adjustment period t2 for setting the potential applied to all the common wirings COMm and the potential applied to all the segment wirings SEGn are set to the same potential within the duty periods t1 as described above. The contrast adjustment period of the 2i-th duty period and the contrast adjustment period of the 2i+1-st duty period are arranged relative to each other. Therefore, it is possible to adjust the contrast without increasing the size of the circuit, and also reduce the frequency of outputting the scanning signals COMm and the display signals SEGn in half, and thereby also realize a low current consumption.

The contrast adjustment period may be arranged at the beginning of the even-numbered duty periods and at the last part of the odd-numbered duty periods. In this case, the contrast adjustment period of the 2i-th duty period and the contrast adjustment period of the 2i−1-th duty period are arranged relative to each other.

(Fourth Embodiment)

As discussed above, the contrast adjustment period t2 is provided at the last part of all the duty periods applied to the liquid crystal drive device according to the second embodiment. In contrast, the liquid crystal drive device according to a fourth embodiment is different in that the arrangement of the positions of the contrast adjustment periods t2 are different between the even-numbered duty periods and the odd-numbered duty periods. Since a configuration of the liquid crystal drive device according to the embodiment is the same as that of the liquid crystal drive device illustrated in FIG. 1, description thereof will be omitted.

Figure 6:
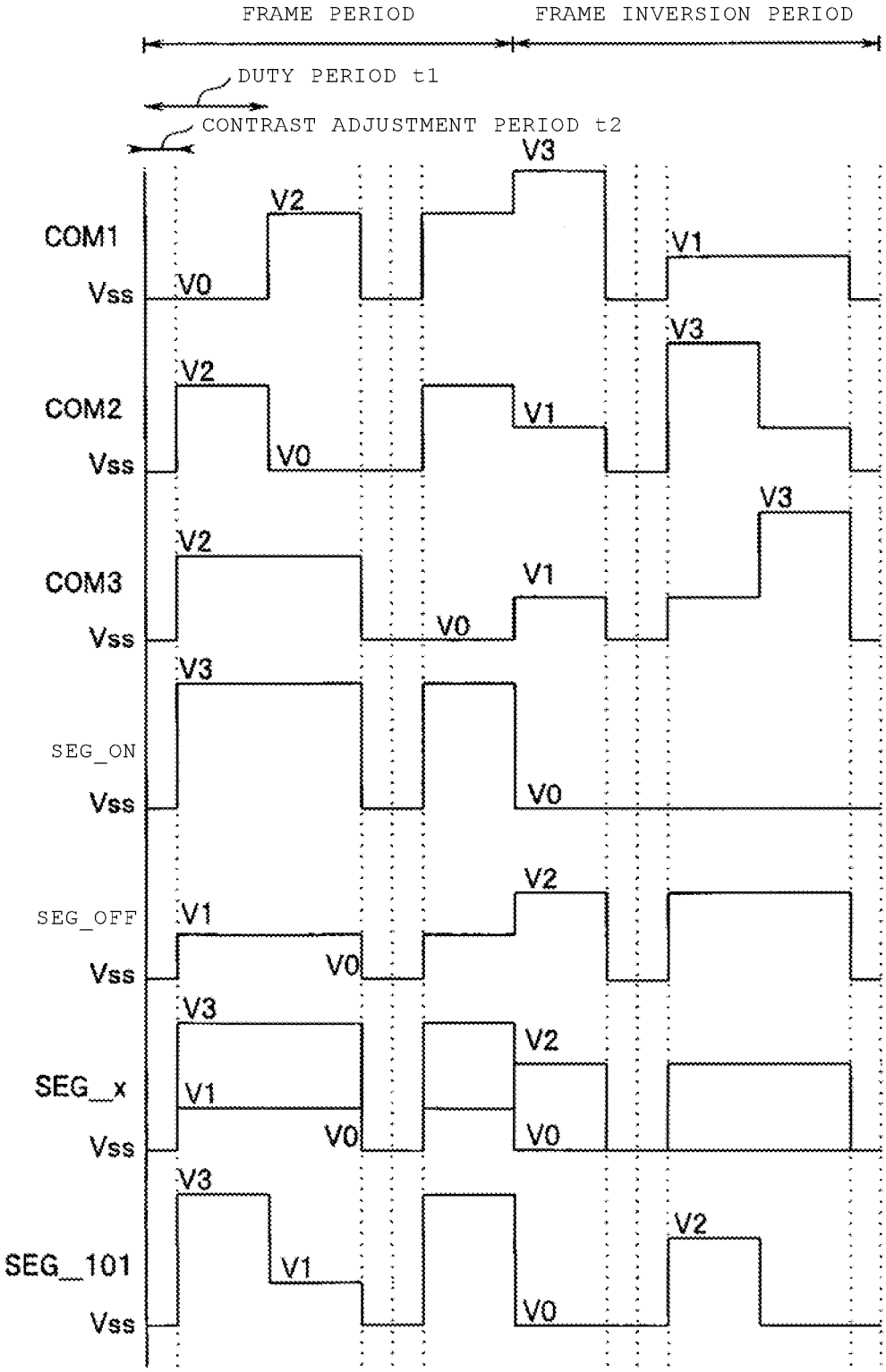
FIG. 6 is a waveform diagram illustrating an example of operations of a liquid crystal drive device according to a fourth embodiment.

FIG. 6 is a waveform diagram illustrating an example of the operation of the liquid crystal drive device according to the fourth embodiment. FIG. 6 illustrates an example of drive waveforms of three scanning signals COM1, COM2, and COM3 in a one-third duty driven liquid crystal drive device. FIG. 6 also illustrates a waveform when all of the display signals SEGn are turned ON (SEG_ON), a waveform when the display signals SEGn are turned OFF (SEG_OFF), a waveform of comprehensive display signals SEGn in a combination of ON and OFF (SEG_x), and a waveform of display signals SEGn when the segment display is "101" (SEG_101).

In the liquid crystal drive device according to the embodiment, both the scanning signals COM1, COM2, . . . COMm and the display signals SEG1, SEG2, . . . SEGn use four values V0, V1, V2, and V3. The basic drive waveforms in the respective duty periods t1 are the same as those of the liquid crystal drive device illustrated in FIG. 3 other than the arrangement of the constant adjustment period t2.

In all the duty periods t1, all the scanning signals COMm and all the display signals SEGn output V0 only in the contrast adjustment period t2 as set by the contrast control signal CC. For the even-numbered duty periods, the contrast adjustment period t2 is arranged at the last part of the duty periods t1. For the odd-numbered duty periods, the contrast adjustment period t2 is arranged at the beginning of the duty periods t1.

That is, the contrast adjustment period of the 2i-th duty period and the contrast adjustment period of the 2i+1-st duty period are arranged relative to each other. With such an arrangement, the potential is maintained at V0 until the contrast adjustment period of the 2i+1-st duty period ends from the time at which the potentials of all the scanning signals COMm and all the display signals SEGn are set to V0 at the start of the contrast adjustment period of the 2i-th duty period. Therefore, it is possible to reduce the frequency of the switching output values of the scanning signals COMm and the display signals SEGn in half without changing the length of the contrast adjustment period t2 arranged in each duty period t1.

According to the embodiment, the contrast adjustment period t2 for setting the potential applied to all the common wirings COMm and the potential applied to all the segment wirings SEGn are set to the same potential within the duty periods t1 as described above. The contrast adjustment period of the 2i-th duty period and the contrast adjustment period of the 2i+1-st duty period are arranged relative to each other. Therefore, it is possible to adjust the contrast without increasing the size of the circuit, and also reduce the frequency of outputting the scanning signals COMm and the display signals SEGn in half even if multiple values are used to drive the wirings, and thereby to realize a lower current consumption.

The contrast adjustment period may be arranged at the top part of the even-numbered duty periods and at the last of the odd-numbered duty periods. In this case, the contrast adjustment period of the 2i-th duty period and the contrast adjustment period of the 2i−1-st duty period are arranged relative to each other.

The respective "units" in the specification are concepts corresponding to the respective functions in the embodiments and do not necessarily have one-to-one correspondence with specific hardware or software routines. Therefore, the description is made in the specification on the assumption of virtual circuit blocks (units) that have the respective functions in the embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein maybe made without departing from the spirit of the inventions. The accompanying claims and their equivalents are intended to cover such forms or modifications as would fall within the scope and spirit of the inventions.

What is claimed is:

1. A liquid crystal drive device that drives a liquid crystal display apparatus, which includes a plurality of common wirings and a plurality of segment wirings, the device comprising:

a common driver configured to sequentially output a scanning signal having a plurality of voltage levels to the plurality of common wirings in a time division manner;

a segment driver configured to output a display signal having a plurality of voltage levels to the plurality of segment wirings; and a contrast adjustment unit configured to generate contrast adjustment periods that are inserted into all duty periods, and output, to the common driver and the segment driver, a contrast control signal to control the timing of when the contrast adjustment periods are inserted into the duty periods in synchronization with the timing of the scanning signal and the display signal, wherein the scanning signal and the display signal are output at an identical potential when a contrast adjustment period is indicated by the output of the contrast control signal.

2. The device according to claim 1, wherein the scanning signal and the display signal have two voltage levels.

3. The device according to claim 2, wherein the contrast adjustment period for setting the potential applied to all the common wirings and the potential applied to all the segment wirings are set to the same potential within the duty periods.

4. The device according to claim 1, wherein the contrast adjustment unit sets the timing at which the contrast adjustment periods are inserted, between even-numbered duty periods and odd-numbered duty periods.

5. The device according to claim 4, wherein the contrast adjustment periods are inserted such that the contrast adjustment periods are inserted into two adjacent duty periods.

6. The device according to claim 1, wherein during the contrast adjustment period the potential applied to all the common wirings and the potential applied to all the segment wirings are the same potential.

7. The device according to claim 1, wherein the scanning signal and the display signal have four voltage levels, and during the contrast adjustment period the potential applied to all the common wirings and the potential applied to all the segment wirings are set to the same potential within each of the duty periods.

8. The device according to claim 1, wherein the contrast adjustment period is different between even-numbered duty periods and odd-numbered duty periods.

9. The device according to claim 8, wherein the contrast adjustment periods are arranged at the last part of the even-numbered duty periods and at the beginning of the odd-numbered duty periods.

10. A method of driving a liquid crystal display apparatus, which includes a plurality of common wirings and a plurality of segment wirings, in a time division manner, the method comprising:

generating a contrast adjustment period within each duty period of a plurality of duty periods;

outputting a contrast control signal to control when the contrast adjustment periods are to be inserted within each duty period, wherein the insertion of the contrast control signal is synchronized with the timing of the switching between duty periods in a time division manner;

outputting a scanning signal having a first potential when the contrast control signal indicates it is within a contrast adjustment period, or otherwise, outputting a scanning signal having at least one of a plurality of voltage levels to the plurality of common wirings in a time divisional manner; and outputting a display signal having the first potential when the contrast control signal indicates it is within the contrast adjustment period, or otherwise, outputting a display signal having at least one of a plurality of voltage levels to the plurality of segment wirings.

11. The method according to claim 10, wherein the scanning signal and the display signal have two voltage levels.

12. The method according to claim 11, wherein the contrast adjustment period for setting the potential applied to all the common wirings and the potential applied to all the segment wirings are set to the same potential within the duty periods.

13. The method according to claim 10, wherein the position in time when the contrast adjustment periods are inserted within even-numbered duty periods is different than the position in time when the contrast adjustment periods are inserted within odd-numbered duty periods.

14. The method according to claim 10, wherein the contrast adjustment periods are inserted such that the contrast adjustment periods are inserted into two adjacent duty periods.

15. The method according to claim 10, wherein during the contrast adjustment period the potential applied to all the common wirings and the potential applied to all the segment wirings are the same potential.

16. The method according to claim 10, wherein the scanning signal and the display signal have four voltage levels, and during the contrast adjustment period the potential applied to all the common wirings and the potential applied to all the segment wirings are set to the same potential within each of the duty periods.

17. The method according to claim 10, wherein the contrast adjustment period is different between even-numbered duty periods and odd-numbered duty periods.

18. The method according to claim 17, wherein the contrast adjustment periods are arranged at the last part of the even-numbered duty periods and at the beginning of the odd-numbered duty periods.

19. A liquid crystal drive device that drives a liquid crystal display apparatus, which includes a plurality of common wirings and a plurality of segment wirings, the device comprising:

a common driver configured to sequentially output a scanning signal having a plurality of voltage levels to the plurality of common wirings;

a segment driver configured to output a display signal having a plurality of voltage levels to the plurality of segment wirings; and a contrast adjustment unit configured to generate contrast adjustment periods that are inserted into all duty periods, and output, to the common driver and the segment driver, a contrast control signal to control the timing of when the contrast adjustment periods are inserted into the duty periods in synchronization with the timing of the scanning signal and the display signal, wherein the contrast adjustment period is different between even-numbered duty periods and odd-numbered duty periods, and the scanning signal and the display signal are output at an identical potential when a contrast adjustment period is indicated by the output of the contrast control signal.

20. The device according to claim 19, wherein the contrast adjustment periods are arranged at the last part of the even-numbered duty periods and at the beginning of the odd-numbered duty periods.

* * * * *